United States Patent [19]

Bauer et al.

[11] Patent Number: 4,589,697

[45] Date of Patent: May 20, 1986

[54] BEARING DEVICE FOR A CHAIR WITH INCLINE-ADJUSTABLE BACK-REST BEARER AND INCLINE-ADJUSTABLE SEAT

[75] Inventors: Hans-Peter Bauer; Hans J. Bauer, both of Altdorf, Fed. Rep. of Germany

[73] Assignee: Fritz Bauer & Söhne oHG, Altdorf, Fed. Rep. of Germany

[21] Appl. No.: 655,094

[22] Filed: Sep. 27, 1984

[30] Foreign Application Priority Data

Sep. 30, 1983 [DE] Fed. Rep. of Germany ..... 3335463

[51] Int. Cl.[4] ..... A47C 3/00

[52] U.S. Cl. ..... 297/300; 297/347

[58] Field of Search ..... 297/300, 339, 347, 355; 248/397

[56] References Cited

U.S. PATENT DOCUMENTS 4,364,605 12/1982 Meiller ..... 297/300 X
4,390,206 6/1983 Faiks et al. ..... 297/300
4,408,800 10/1983 Knapp ..... 297/347 X
4,471,994 9/1984 Zund ..... 297/300

*Primary Examiner*—James T. McCall
*Attorney, Agent, or Firm*—Browdy and Neimark

[57] ABSTRACT

A height-adjustable office chair having an incline-adjustable seat and back includes a bearing device to which is connected a length-adjustable seat pneumatic spring connected by an articulated joint to the seat structure, a length-adjustable back-rest pneumatic spring connected to the back by an articulated joint, and a height-adjustable pneumatic spring. The actuating rods of all three of these pneumatic springs are in the bearing device and are controlled by an actuating lever movable both horizontally and vertically. Vertical movement of the actuating lever controls the height-adjustable pneumatic spring. Horizontal movement of the actuating lever serves to control one of two intermediate levers which are respectively arrestable and lockable by a detent lever located above the height-adjustable pneumatic spring.

10 Claims, 4 Drawing Figures

BEARING DEVICE FOR A CHAIR WITH INCLINE-ADJUSTABLE BACK-REST BEARER AND INCLINE-ADJUSTABLE SEAT

FIELD OF THE INVENTION

The present invention relates to a bearing device employed in a chair having an incline-adjustable back-rest and seat, and more particularly to a bearing device which is provided with an arrangement of resiliently biased levers having cooperating detents for rendering gas springs, associated with and interconnecting the back rest and seat to the bearing device, operable to permit pivoting adjustment of the back-rest and the seat.

BACKGROUND OF THE INVENTION

German Offenlegungsschrift DE-OS No. 29 29 428 (corresponding to European Pat. EP-PS No. 0 022 933) discloses such a type of bearing having a sliding block with different guide channels provided as the guide channel in which there is a mandatory guidance and fixing into position of the actuating lever made possible in a deflected position. In this manner the actuating lever may be swivelled horizontally in one or another direction in a guide channel, so that in each instance, insertion of the actuating rod of a pneumatic spring is achieved. By this means also, it is possible each time to effect a separate alteration of the inclination of the seat or of the back-rest. In order to render the seat and the back rest freely tiltable and thus to nullify the arresting action of the pneumatic spring concerned, the actuating lever may be shifted upwards in a vertical channel of the sliding block and elastically engaged in position. In this location, the appropriate sections of ring which are formed on the actuating lever and which are in contact with the intermediate levers will push these intermediate levers apart in a scissors-like action, so that both actuating pins are pushed into the corresponding pneumatic springs. Since the actuating lever is locked into this position, the actuating rods remain opened, so that the seat and the back-rest may be tilted back and forth—against the existing gas pressure in the pneumatic spring. Since the ring formed on the actuating lever surrounds the chair support column, it is not possible to alter the position of the pneumatic spring forming this chair column. In a practical embodiment, a separate actuating lever is provided for this purpose. Moreover, it is not possible to selectively arrest the actuating rod in the pushed-in position solely for the back-rest pneumatic spring or for the seat pneumatic spring. U.S. Pat. No. 3,837,704 discloses a chair having its support column formed from a length-adjustable pneumatic spring and having an incline-adjustable back-rest controlled by a pneumatic spring, so that by means of an actuating lever which may be swivelled only horizontally and vertically it is possible selectively to adjust the length of the support column or the incline of the back-rest. In this case it is not possible to adjust the slope of the seat, nor is provision made for arresting the actuating rod in its pushed-in position.

A similar solution of the problem is known from the Swiss Pat. No. 563 753.

OBJECTS AND SUMMARY OF THE INVENTION

The present invention overcomes the above-described drawbacks of the previously known devices by providing a bearing device of the generic type which is simplified in construction, and includes separately arrestable actuating rods for both the back-rest pneumatic spring and for the seat pneumatic spring.

This problem is solved according to the invention by providing that the actuating lever itself not be arrested in the position in which either one or the other of the actuating rods is arrested. On the contrary, it is the actuating lever which is used only for the swivelling of the intermediate levers which, in their fully displaced positions are themselves locked into this position by means of the appropriate detent lever, and thus the actuating rod allocated to a pneumatic spring is also locked into this position. This configuration also makes it possible to utilize the actuating lever for adjusting the length of the support column because it is always available for use; even when the back-rest pneumatic spring and/or the seat pneumatic spring are set for tilting operation the actuating lever is still available to perform other functions, for example the adjustment of the height of the chair support column.

Disposition of the detent levers in predominantly a horizontal direction above the actuating lever makes length adjustment of the back-rest pneumatic spring or of the seat pneumatic spring possible only requiring swivelling of the actuating lever in the appropriate horizontal direction. Under such conditions for length adjustment, it is not necessary to move the lever as far as is required for the detent engagement of the intermediate lever. The release of the locking engagement then occurs by a simple upwards movement of the appropriate actuating section of the actuating lever against the detent lever(s).

The present invention further make it possible to configure at least a section of the actuating lever in the shape of a rod for cooperative coaction with the actuating rod and intermediate levers of the chair support column.

BRIEF DESCRIPTION OF THE DRAWINGS

Further advantages and characteristics of the invention will become, apparent from the following description of an exemplary embodiment, making reference to the drawings in which.

DETAILED DESCRIPTION OF THE INVENTION

Figure 1:
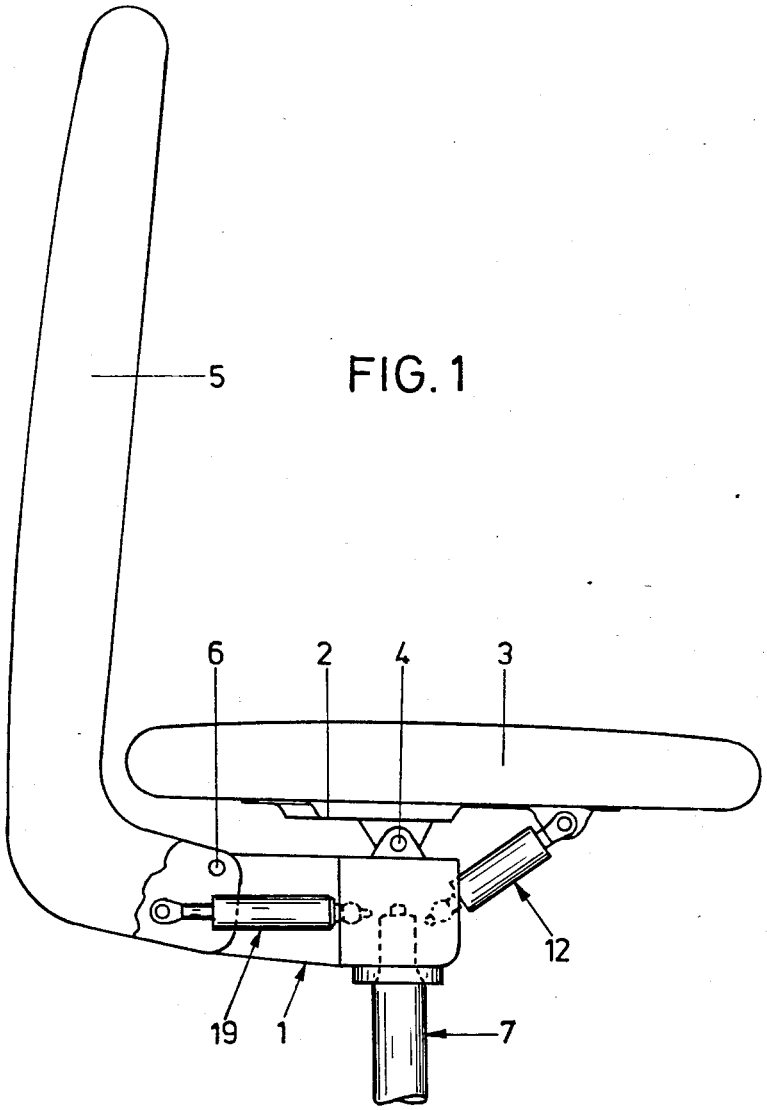
FIG. 1 illustrates a bearing device in accordance with the present invention having an incline-adjustable support plate for a seat and an incline-adjustable back-rest.
Figure 2:
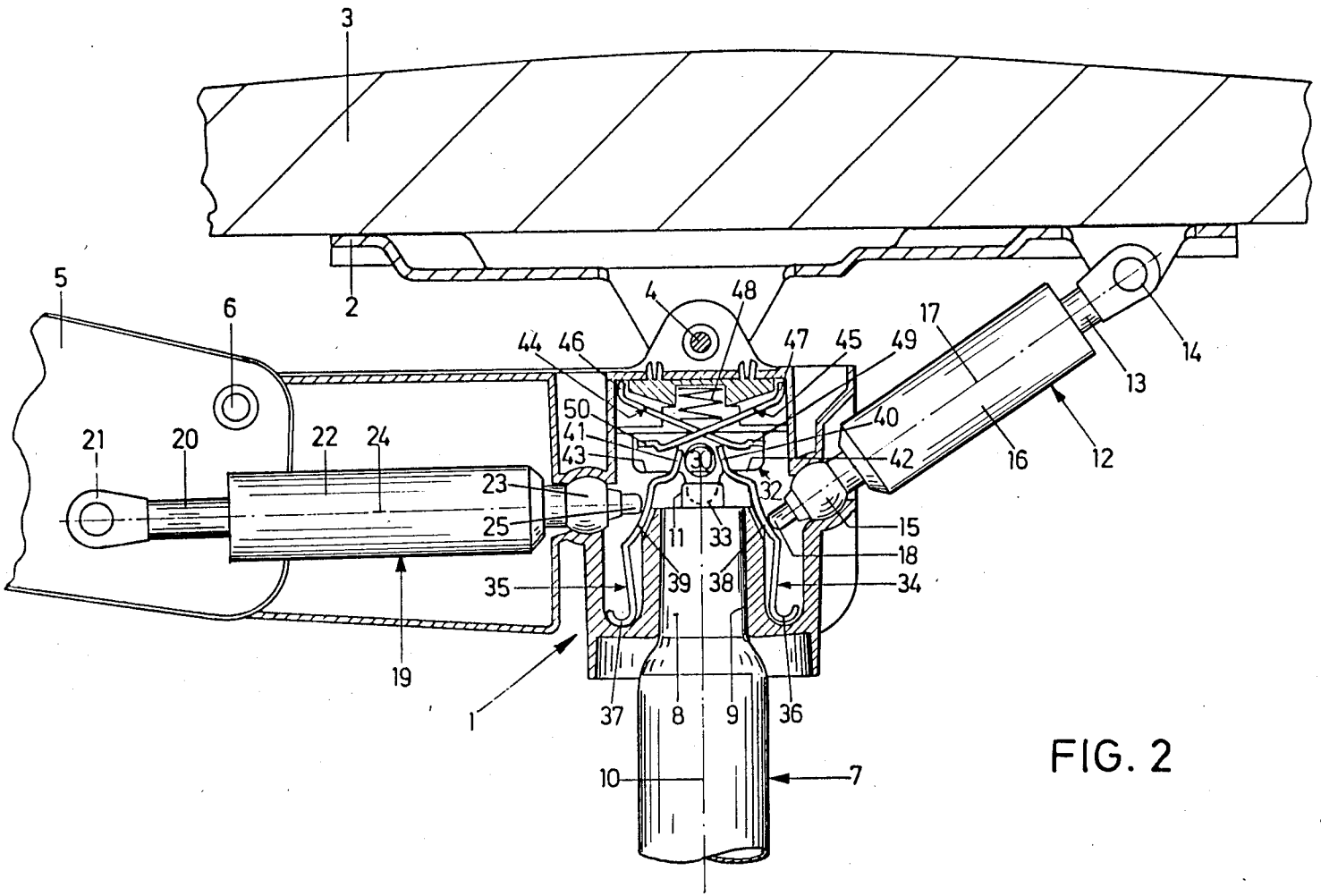
FIG. 2 shows, in partial section, the bearing device in enlarged scale.

As shown in FIGS. 1 and 2, a support plate 2 for a seat 3 of an office chair is located above a bearing device 1 having a housing-like configuration, the chair seat being tiltably adjusted around a horizontal pivot axis 4. A back-rest bearer 5 is attached to the bearing device 1, with the slope of the said bearer 5 being adjustable around a horizontal pivot axis 6. The pivot axes 4 and 6 extend parallel to each other and perpendicular to a centrally located vertical plane through the office chair, which is a plane of symmetry and parallel to the plane of FIGS. 1 and 2. The bearing device 1 is supported on a height-adjustable chair support column 7 which fundamentally consists of a length-adjustable pneumatic spring, the latter being connected to a foot framework or to a connectable guide tube for its support.

The constructional details and method of operation of these commercialy available pneumatic springs is depicted and described, for example, in the German Pat. DE-PS No. 18 12 282 (corresponding to the U.S. Pat. No. 3,656,593). The configuration of a chair support column which is likewise commercially available and is furnished with a guide tube is also known, for example from the German Pat. DE-PS No. 19 31 012 (corresponding to the U.S. Pat. No. 3,711,054).

The pneumatic spring 7, which serves as the chair support column, is furnished at its upper end with a truncated conical-shaped holding section 8 (se FIG. 2) held within a matching truncated conical-shaped recess 9 in the base of the bearing device 1. The chair support column 7 projects vertically downwards from the bearing device 1. Coaxially with the central longitudinal axis 10 of the chair support column 7 there is an actuating rod 11 projecting upwards out of the holding section 8; this rod may be displaced vertically for the adjustment of the height of the chair support column 7.

With particular reference to FIG. 2, it can be seen that the support plate 2 for the seat 3 may be swivelled around the pivot axis 4 by means of a seat pneumatic spring 12. The free end of the piston rod 13 of the seat pneumatic spring 12 is connected by means of the articulated joint 14 to the front end of the support plate 2, which is in the region facing away from the back-rest bearer 5. The other end of the seat pneumatic spring 12 is pivotably connected to the bearing device 1 by means of a ball joint 15 so that the essentially cylindrical housing 16 of the seat pneumatic spring 12 may only be pivoted relative to the bearing device 1 and not displaced in its own longitudinal direction.

The seat pneumatic spring 12 may be adjusted for length and is of the same fundamental type of structure as the chair support column 7, that is to say, its construction likewise corresponds to that described in DE-PS No. 18 12 282 (corresponding to the U.S. Pat. No. 3,656,593). An actuating rod 18, which is displaceable in the direction of the central longitudinal axis 17 of the seat pneumatic spring 12 for the initiation or the termination of a length adjustment of the seat pneumatic spring 12, projects out through the ball joint 15 into the interior of the bearing device 1.

A back-rest pneumatic spring 19 is also provided for the incline-adjustment of the back-rest bearer 5. Spring 19 corresponds in construction and function to the seat pneumatic spring 12, and is connected at the free end of its piston rod 20 to the back-rest bearer 5 by means of an articulated joint 21 at a predetermined distance away from the pivot axis 6. At the other end of its cylindrical housing 22, the seat pneumatic spring 12 is pivotably connected to the bearing device 1 by means of a ball joint 23 in such a way that it cannot be displaced in the direction of its central longitudinal axis 24. An actuating rod 25 for the length adjustment of the back-rest pneumatic spring 19 projects into the interior of the bearing device 1. The three central longitudinal spring axes 10, 17, 24 all lie in the same plane which coincides with the already mentioned main central vertical plane of the office chair.

For the direct, or indirect actuation of the actuating rods 11, 18, 25 there is provided actuating lever 26 (see FIG. 3) having a central longitudinal axis 27 which is approximately perpendicular to the three spring axes 10, 17, 24, and thus also approximately perpendicular to the above-described main central vertical plane of symmetry of the chair. A hand-grip 28 on the free outer end of the actuating lever 26 is thus located laterally of, and slightly below, the support plate 2 or the seat 3 so that the actuating lever 26 may be easily reached and operated by a person seated on the chair. The actuating lever 26 may be moved in all directions because it is mounted in the ball joint 29 located in the frame of the bearing device 1. To accomplish direct, or indirect, actuation of the actuating rods 11, 18, 25, an actuating section 30 of the actuating lever 26 passes from the ball joint 29 to project into the interior of the bearing device 1. The actuating lever 26 is thus carried on a bearing in a region between the actuating rods 11, 18, 25 and the outer end of the lever formed by the hand-grip 28.

Figure 3:
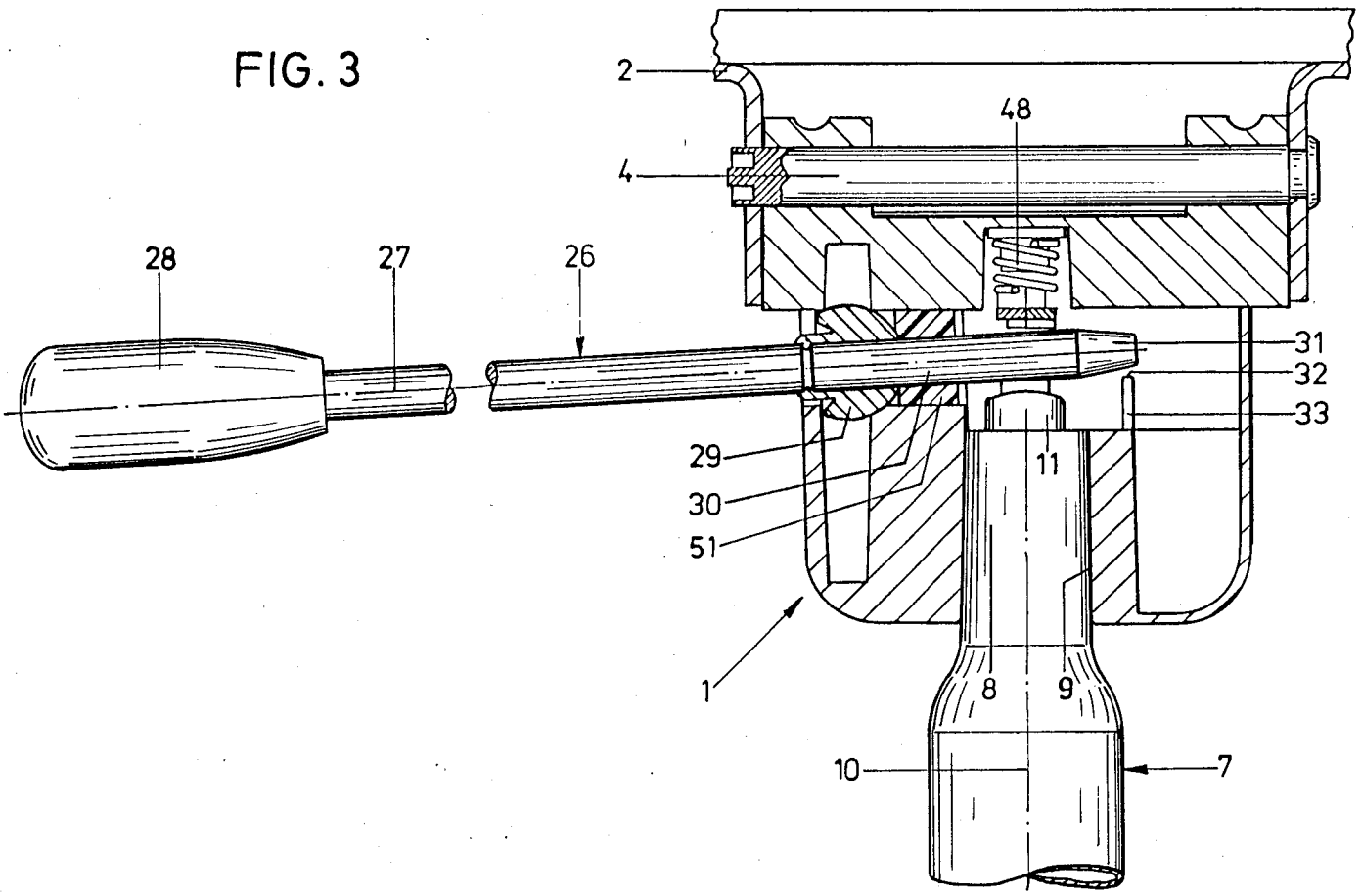
FIG. 3 shows a sectional view through the bearing device along the line III—III in FIG. 2.

As best seen in FIGS. 2 and 3, the actuating section 30 possesses a tapered guide section 31 on its free end which moves in a guide channel 32. This guide channel 32 has—as indicated in FIG. 2—a major portion which is essentially horizontal and possesses a central section 33 extending downwards for accommodating its interaction with the actuating rod 11 carried by the chair support column 7. When the actuating lever 26 is moved out of its central position as depicted in the drawing and pivoted in a vertical plane so that the hand-grip 28 is lifted upwards thereby causing the guide section 31 to move downwardly into the channel section 33, the actuating section 30 of the actuating lever 26 is pivoted downwards into engagement with the actuating rod 11 of the chair support column 7 causing the actuating rod to be pushed down into the column. This interaction causes the internal actuating valve of support column 7 to be opened, and the chair support column 7 can then be lengthened or shortened in the usual known manner so that the support plate 2 with the seat 3 may have its height adjusted.

Figure 4:
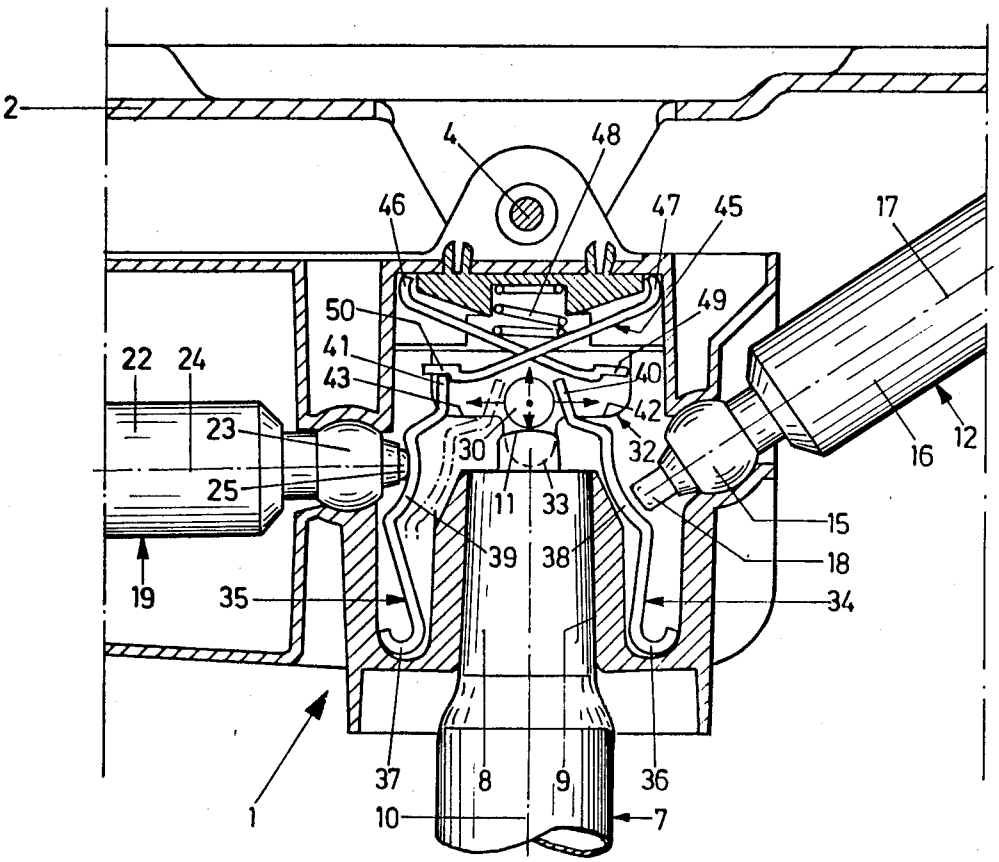
FIG. 4 shows partial section of the bearing device corresponding to that represented in FIG. 2 in a displaced situation.

As best seen in FIGS. 2 and 4, in the lower region of the bearing device there are two mirror-image symmetric intermediate levers 34, 35 pivotably mounted on semicircular curved lower ends 36, 37, at opposing sides of the recess 9 and thus on opposite sides of the chair support column 7. These intermediate levers actually confront the actuating rods 18 and 25 of the seat pneumatic spring 12 and the back-rest pneumatic spring 19 respectively. The actuating rods 18 and 25 of the said springs come into contact with the bearing surfaces 38, 39 of the intermediate levers 34, 35 at the central region where they are concave on the side facing the actuating rods. Because of the curvature of the bearing surfaces 38, 39, the actuating rods 18 and 25 remain in contact with the bearing surfaces 38 and 39 in all the different pivoted positions of the seat pneumatic spring 12 or of the back-rest pneumatic spring 19 without any displacement, and therefore actuation, of the actuating rods 18 and 25 as a result of the different pivoting locations. Thus the concave curved parts of the bearing surfaces 38, 39 runs approximately concentrically to each of the ball joints 15 and 23 respectively.

The upper free ends of the intermediate levers 34, 35 are formed respectively from the inwardly angled offsets of the bearing surfaces 38, 39 to form the detent sections 40, 41 which are located on either side of the actuating section 30 of the actuating lever 26 when it is in the resting position and there is a small amount of play between the detent sections and the section 30. If the actuating lever 26 is pivoted in an approximately horizontal plane —either backwards or forwards in parallel relation to the horizontal extent of support plate 2 of the seat 3—then either the intermediate lever 34, with the corresponding actuation of the actuating rod 18 of the seat pneumatic spring 12, or the intermediate lever 35, with the corresponding actuation of the actuating rod 25 of the back-rest pneumatic spring 19, is pivoted outwards from its resting position. With such a corresponding actuation it is thus possible to alter the slope of the support plate 2 with the seat 3 or the slope of back-rest bearer 5 by pivoting around the pivot axes 4 and 6 respectively. When the hold on the hand-grip 28 of the actuating lever 26 is released by the person operating it, it is then pushed back into its central position by either actuating rod 18 or 25 by way of the corresponding intermediate lever 34 or 35, respectively. The valve of the corresponding pneumatic spring is then closed by either the actuating rod 18 or 25, whichever happens to be functioning. The support plate 2 and/or the back-rest bearer 5 is/are now once again fixed in a new inclined position. With the horizontal pivoting movement of the actuating section 30 of the actuating lever 26, the section 30 is caused to move along in the sections 42 or 43 of the guide channel 32 located above the channel section 33 which extends vertically downwards.

Above the actuating levers, two crossed-over detent levers 44, 45 are located within the bearing device 1 which, because of their outer upper curved ends 46, 47, are pivotably supported within the bearing device 1. These detent levers are forced downwards by means of a compression spring 48 located concentrically to the central longitudinal axis 10, so that their lower, approximately horizontal, slightly upwardly angled offset ends 49, 50 are in contact with the detent sections 40 and 41 of the intermediate levers 34, 35. The cross-over point of the two detent levers 44, 45 lies immediately above the actuating section 30 of the actuating lever 26.

When the actuating lever 26 is pivoted horizontally in such a manner that the intermediate lever 34 associated with the seat pneumatic spring 12 is pivoted with actuation of the corresponding actuating rod 18, then during this pivoting movement, the free end 49 of the detent lever 44 if lifted onto the detent section 40 of the intermediate lever and pressed down against it, because the detent lever is displaced upwards to a slight extent against the pressure of the compression spring 48 due to the pivoting of the intermediate lever 34. If now there is to be an adjustment to the length of the seat pneumatic spring 12 which would result in an alteration of the slope of the support plate 2 of the seat 3, then the situation will remain the same as described. However, if the actuating rod 18 is to be arrested in its pushed-in position in the seat pneumatic spring 12, so that the internal valve of the seat pneumatic spring 12 will remain in the opened position, then the actuating lever 26 is pivoted so far in the horizontal direction that the detent section 40 of the intermediate lever engages with the angled offset end 49 of the detent lever 44. Under these conditions the detent lever 44 is forced downwards by the compression spring 48 and comes to rest with its angled offset end 49 on and behind the detent section 40 of the intermediate lever 34. In a similar fashion it is possible for the actuating rod 25 of the back-rest pneumatic spring 19 to be pushed in for a slope adjustment of the back-rest bearer 5 or it can be selectively arrested in the pushed-in position in which the lower angled offset end 50 of the detent lever 45 will be seated upon and behind the detent section 41 of the intermediate lever 35 as depicted in FIG. 4. For releasing the arrest of one or both intermediate levers 34 and/or 35, and at the same time one or both of the actuating rods 18 and/or 25, the hand-grip 28 of the actuating lever 26 is pushed downwards in the middle position, by which means its actuating section 30 is forced upwards against the cross-over region of the two detent levers 44, 45. This results in an upward lifting of these levers along with their angled offset ends 49, 50 to such an extent that one or both of the actuating rods 18 and/or 25 can force back the corresponding intermediate lever(s) 34 and/or 35 into its/their resting position(s). The actuating lever 26 is brought back into its central resting position each time by means of an elastic cushion 51 (see FIG. 3), made for example from expanded polyurethane foam, and the lever remains in that position till positively moved again.

What is claimed is:

1. In a bearing device for an incline-adjustable back-rest bearer and an incline-adjustable support plate for a seat of a height-adjustable chair, in particular an office chair, including a length-adjustable seat pneumatic spring on the bearing device connected by an articulated joint to the support plate, a length-adjustable back-rest pneumatic spring on the bearing device connected to the back-rest bearer by an articulated joint, a chair support column formed from a length-adjustable pneumatic spring which likewise is connected to the bearing device, the actuating rods of the seat pneumatic spring and of the back-rest pneumatic spring being directed towards each other and each one of the rods being in contact with one or two intermediate levers which are pivotably movable by means of an actuating lever movable in an approximately horizontal guide channel sot hat when the intermediate levers are in the position of their greatest displacement where the actuating rod concerned is pushed into the seat pneumatic spring or the back-rest pneumatic spring, they are arrestable and lockable into that position, and further including an actuating rod for the pneumatic chair support column located between the two intermediate levers which is actuated by the actuating lever, the improvement comprising:

a detent lever associated and resiliently acting in conjunction with each of the intermediate levers, said detent levers being located above the chair support column, a corresponding detent lever engaging behind its respective intermediate lever after that lever is pivoted outwardly away from the actuating lever, and wherein said guide channel has a central vertically extending channel section to allow for the actuation of the actuating rod of the chair support column.

2. The improvement in accordance with claim 1, wherein said detent levers are located to extend predominantly in a horizontal direction above the actuating lever.

3. The improvement in accordance with claim 1, wherein the actuating lever has an actuating section configured in the shape of a rod to act in conjunction with the intermediate levers and the actuating rod of the chair support column.

4. The improvement in accordance with claim 2, wherein the actuating lever has an actuating section configured in the shape of a rod to act in conjunction with the intermediate levers and the actuating rod of the chair support column.

5. The improvement in accordance with claim 1, wherein the detent levers are pivotably mounted at their upper outer ends and are arranged to cross over one another so that their free lower ends may act in conjunction with the intermediate levers.

6. The improvement in accordance with claim 2, wherein the detent levers are pivotably mounted at their upper outer ends and are arranged to cross over one another so that their free lower ends may act in conjunction with the intermediate levers.

7. The improvement in accordance with claim 3, wherein the detent levers are pivotably mounted at their upper outer ends and are arranged to cross over one another so that their free lower ends may act in conjunction with the intermediate levers.

8. The improvement in accordance with claim 5, wherein a compression spring acts on the detent levers to force them in the direction towards the intermediate levers.

9. The improvement in accordance with claim 6, wherein a compression spring acts on the detent levers to force them in the direction towards the intermediate levers.

10. The improvement in accordance with claim 7, wherein a compression spring acts on the detent levers to force them in the direction towards the intermediate levers.

* * * * *